US009117340B2

(12) United States Patent
Popovich et al.

(10) Patent No.: US 9,117,340 B2
(45) Date of Patent: Aug. 25, 2015

(54) PLAYER TRACKING THROUGH TOUCH SURFACE SIGNAL CONDUITS

(71) Applicant: IGT, Las Vegas, NV (US)

(72) Inventors: Alexander Popovich, Henderson, NV (US); William McMaster, Las Vegas, NV (US)

(73) Assignee: IGT, Las Vegas, NV (US)

( * ) Notice: Subject to any disclaimer, the term of this patent is extended or adjusted under 35 U.S.C. 154(b) by 10 days.

(21) Appl. No.: 13/909,932

(22) Filed: Jun. 4, 2013

(65) Prior Publication Data

US 2014/0357353 A1 Dec. 4, 2014

(51) Int. Cl.
*A63F 9/24* (2006.01)
*G07F 17/32* (2006.01)

(52) U.S. Cl.
CPC ..... *G07F 17/3239* (2013.01)

(58) Field of Classification Search
CPC ..... G06F 3/044; G06F 3/0416; G06F 2203/04111; G06F 3/041; G06F 3/046; G07F 7/0873; G08C 17/06; H04M 2250/22
USPC ..... 463/39, 43
See application file for complete search history.

(56) References Cited

U.S. PATENT DOCUMENTS 6,771,161 B1 * 8/2004 Doi et al. ..... 340/5.64
8,125,459 B2 2/2012 Mattice et al.
2010/0289673 A1 * 11/2010 Kim et al. ..... 341/20
2011/0304583 A1 * 12/2011 Kruglick ..... 345/174
2013/0023339 A1 1/2013 Davis et al.
2013/0194227 A1 * 8/2013 Chang ..... 345/174
2014/0184555 A1 * 7/2014 Pi et al. ..... 345/174

FOREIGN PATENT DOCUMENTS

JP 2000-148396 A 5/2000

OTHER PUBLICATIONS

Patent Abstracts of Japan for Japanese Publication No. 2000-148396, publication date May 26, 2000 (2 pages).
David Talbot, Replacing Your Password With a Finger Swipe published in MIT Technology Review, Aug. 31, 2012 (2 pages).

* cited by examiner

*Primary Examiner* — Steve Rowland
(74) *Attorney, Agent, or Firm* — Neal, Gerber & Eisenberg LLP

(57) ABSTRACT

A method of player tracking includes generating, by a transmitting device, a signal modulated to contain an identification of the transmitting device, charging at least a portion of a first touch surface on the transmitting device with the signal such that the signal is present and transmittable, transmitting, the signal from the first touch surface through the signal conduit to a second touch surface on a receiving device, receiving, by a gaming system, an authentication request comprising the identification, authenticating, by the gaming system, the transmitting device based on the identification, and linking, by the gaming system, the transmitting device with the receiving device.

18 Claims, 11 Drawing Sheets

[2

PLAYER TRACKING THROUGH TOUCH SURFACE SIGNAL CONDUITS

BACKGROUND

1. Technical Field

One or more embodiments of the present disclosure relate generally to communications between wager-based gaming machines and mobile devices, and more specifically to establishing associations between players, mobile devices and the gaming machines players play.

2. Background Art

In gaming environments, many patrons allow their activities to be tracked in exchange for the prospect of receiving various incentives. Currently, this is achieved via a 'Player Tracking' (PT) card which contains an embedded magnetic strip that stores identifying information.

When a patron wishes to play a specific Electronic Gaming Machine (EGM), they insert their PT card into a slot located on the EGM, so that from then, until the card is removed, all bets, wins, losses and other events occurring at the EGM will be associated with the card's owner. While card use is an accepted practice, it is an inconvenience for both the operator and patron alike.

For the operator, there are material and labor costs associated with issuing cards. Additionally, there are large expenses associated with the purchase and maintenance of card readers placed in every EGM, which for a large casino, may number in the thousands.

The patron too is inconvenienced in that they have to visit a registration area to first request the card and then handle the card each time they approach or leave an EGM. Furthermore, players may inadvertently forget to remove their card when they leave. Cards are misplaced so frequently that many casinos also give lanyards to their customers that are used to tether the card to a part of the patron's clothing. While a tether ensures that the card remains with its owner, it is an ergonomic inconvenience that obstructs game play. It also detracts from the visual ambiance of a casino to see player with cords strung between them and EGMs. Given these shortcomings, it would be desirable to devise a less costly, more convenient, and more contemporary alternative to the current, card based player tracking products.

Alternatives to PT cards have previously been proposed. For example, one proposal suggests that a player's personal cellular phone or PDA emit an identifying message using the Bluetooth protocol. This signal would be received by multiple EGMs in close proximity. Then, by using an estimate of relative field strength, the hope is that a specific EGM can be identified as the one with which the player wishes to establish a link. Unfortunately, there are several reasons why this approach may be unreliable. One reason is that EGMs are so densely packed together in casinos that the signals would be received by multiple EGMs with essentially identical field strength. Additionally, the Bluetooth protocol can be susceptible to degradation from Radio Frequency (RF) noise and the presence of many large, RF reflective and/or absorptive metal surfaces (many EGM electronics and cabinets). Despite such concerns, it would be desirable to offer patrons a more convenient alternative to that of a tethered PT card.

SUMMARY OF THE CLAIMED SUBJECT MATTER

In one aspect, embodiments of the present disclosure relate to a method of player tracking including generating, by a transmitting device, a signal modulated to contain an identification of the transmitting device, charging at least a portion of a first touch surface on the transmitting device with the signal such that the signal is present and transmittable, transmitting, the signal from the first touch surface through the signal conduit to a second touch surface on a receiving device, receiving, by a gaming system, an authentication request comprising the identification, authenticating, by the gaming system, the transmitting device based on the identification, and linking, by the gaming system, the transmitting device with the receiving device.

In another aspect, embodiments of the present disclosure relate to a system to track players including a transmitting device comprising a first touch surface and configured to generate a signal modulated to contain an identification of the transmitting device, to charge at least a portion of the first touch surface with the signal such that the signal is present and transmittable and to transmit, in response to the contact, the signal from the first touch surface through the signal conduit to a second touch surface on a receiving device, the receiving device comprising the second touch surface and configured to receive the signal through the signal conduit and to send, to a gaming system, an authentication request, the gaming system configured to receive an authentication request comprising the identification, to authenticate the transmitting device based on the identification and to link the transmitting device with the receiving device.

In another aspect, embodiments of the present disclosure relate to a non-transitory computer-readable medium (CRM) storing a plurality of instructions for player tracking comprising functionality to generate a signal modulated to contain an identification of a transmitting device, to charge at least a portion of a first touch surface on the transmitting device with the signal such that the signal is present and transmittable, to transmit, in response to the contact, the signal from the first touch surface through the signal conduit to a second touch surface on a receiving device, to receive, by a gaming system, an authentication request comprising the identification, to authenticate, by the gaming system, the transmitting device based on the identification, and to link the transmitting device with the receiving device.

In another aspect, embodiments of the present disclosure relate to an electronic gaming machine (EGM) including a first touch surface, a transmitting device, and a processor, wherein the processor is configured to capacitively communicate a signal between the EGM and a mobile computing device.

Other aspects and advantages of the invention will be apparent from the following description and the appended claims.

DETAILED DESCRIPTION

Figure 1A:
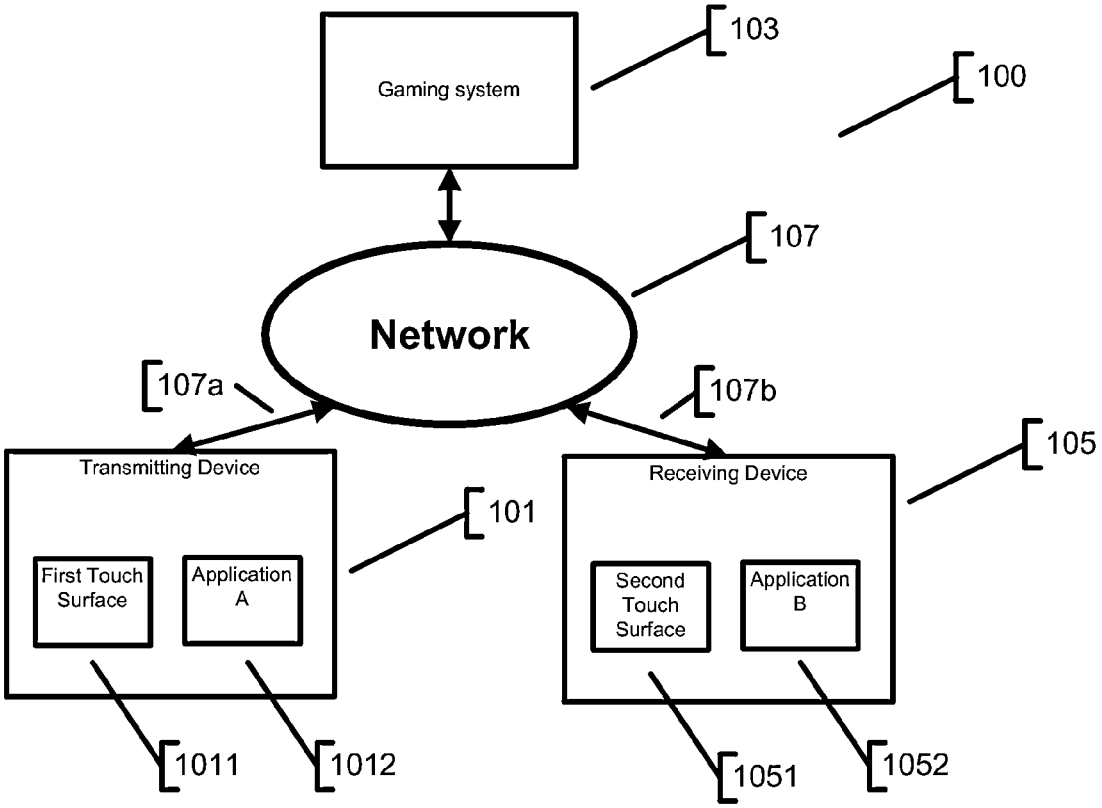
FIGS. 1A and 1B show system diagrams according to one or more embodiments of the present disclosure.

In embodiments described herein, numerous specific details are set forth in order to provide a more thorough understanding of the invention as claimed. However, it will be apparent to one with ordinary skill in the art that the disclosure may be practiced without these specific details. In other instances, well-known features have not been described in detail to avoid obscuring the invention.

One or more embodiments of the present disclosure relate generally to a player's smartphone or equivalent Personal Digital Assistant (PDA) device serving as a player tracking alternative, which may be able to establish a one-to-one linkage between the PDA and one or more specific EGMs selected by the player.

Specifically, according to one or more embodiments of the present disclosure, a method uses a small electrical signal between devices, particularly an EGM or other object and a player's phone, where the player's body may serve as a signal conduit.

According to one or more embodiments of the present disclosure, a method which uses the player's phone may offer several advantages relative to current PT systems. For example, the patron may no longer need to obtain or carry any additional physical item beyond what is normally in their possession (e.g. phone or other PDA). Additionally, a phone based method may also serve the PT needs of multiple casinos, rather than possessing PT cards for each property. Also, this method may not require physical insertion of an object into the EGM and may entail minimal or no expense associated with the purchase and maintenance of EGM equipment dedicated solely to player tracking.

Current smart phones use a touchscreen which can simultaneously recognize multiple fingers touching the screen. For example, a pinching gesture may be used to expand or shrink an image. The prevailing technology used to detect multi-touch gestures is 'projected capacitance'. This technology detects changes in capacitance when fingers or other objects either touch or move within close proximity of a touch sensitive surface. Additionally, these sensors may detect changes in the voltage potential of those same objects. Therefore, according to one or more embodiments of the present disclosure, an electrical charge, modulated to form a pattern such as a 'Morse Code' or other signal protocol, is applied to a touch surface of the EGM. The modulation rate is optimized to work in conjunction with the sampling rate of the cell phone or PDA touchscreen sensors. Such sampling may typically occur within a range of about 40 Hertz to about 120 Hertz. Signal characteristics such as the pattern, rate, and time of pattern initiation may be used to ensure that each EGM within a casino can be uniquely identified. According to one or more embodiments of the present disclosure, the electrical charge is optimized with consideration to the human body capacitance and resistance model, which the Electrostatic Discharge Association, has approximated to be equivalent to a series connection of a 100 picofarad capacitor and a 1500 Ohm resistor.

If a player touches the charged surface of the EGM while contacting any part of the touchscreen on their phone, the touchscreen's capacitance sensors will sense the charge. A 'Player Tracking Application' on the phone will read the touchscreen sensor data in order to recognize and optionally, decode the signal represented by the charge modulations. This code, augmented with encoded information identifying the phone and its owner, can be transmitted to a PT server, which then associates a player with the specific EGM they touched.

According to one or more embodiments of the present disclosure in the gaming environment, the modulated charge emanates from a surface of the EGM. The association of an EGM with a unique modulation pattern, augmented with identifying information supplied by the player's smart phone, enables a player tracking function.

Alternatively, in one or more embodiments of the present disclosure, a modulated charge is generated by a device which is being held by a player. This signal is then transmitted from the device, which may be the player's phone, to the EGM. The EGM may then, either at the EGM or elsewhere in the gaming system, establish the identity of the player and link the player with the EGM that the player has touched. In this embodiment, if the player's mobile computing device, cell phone or PDA, lacks a network connection within the gaming environment, the player may still connect and link with the EGM. Particularly, this embodiment provides for a signal path from the player's mobile computing device to the gaming system and then through a network path controlled by the gaming environment rather than relying upon third party network connections provided by, for example, such parties as the player's cellular provider.

FIG. 1A discloses a player tracking system 100 according to one or more embodiments of the present disclosure. The transmitting device 101 includes a first touch surface 1011 as well as software in the form of a specific Application A 1012 which provides the functionality necessary to generate a signal in the form of a modulated charge. The transmitting device 101 may generate the signal continuously and rely on Application B 1052 to detect the signal only as required. Alternatively, a first touch surface 1011 may include means for detecting a contact, and briefly transmit the code through the contacting conduit upon detecting contact. The software Application A 1012 generates a signal which includes an identification of the transmitting device and may also contain other game related information.

The player tracking system 100 also includes a receiving device 105 which contains a second touch surface 1051 and a software Application B 1052. The second touch surface 1051 may also have the ability to detect a contacting conduit and is sensitive enough to detect the modulated charge that is transmitted by the transmitting device 101 through the network 107, of which the conduit may be a part. Thus, the transmitting device 101 transmits a signal from the first touch surface 1011 through the conduit, which may be part of the network 107, to the receiving device 105 via the second touch surface 1051.

The Application A 1012 is designed to generate and transmit a modulated charge that the Application B 1052 understands or is able to receive and then forward. Specifically, once received, the receiving device 105 may communicate the signal with the gaming system 103 through a different part, e.g. (107*a*, 107*b*), of the network 107. Particularly, the receiving device 105 may have a wired connection, a wireless connection, or both with the gaming system 103 through which the receiving device 105 communicates at least the signal and possibly other information identifying itself and, if applicable, game information. Further, the transmitting device 101 may also have a communicative path, e.g. (107*a*, 107*b*), with the gaming system 103 through which related information is transmitted.

Figure 1B:
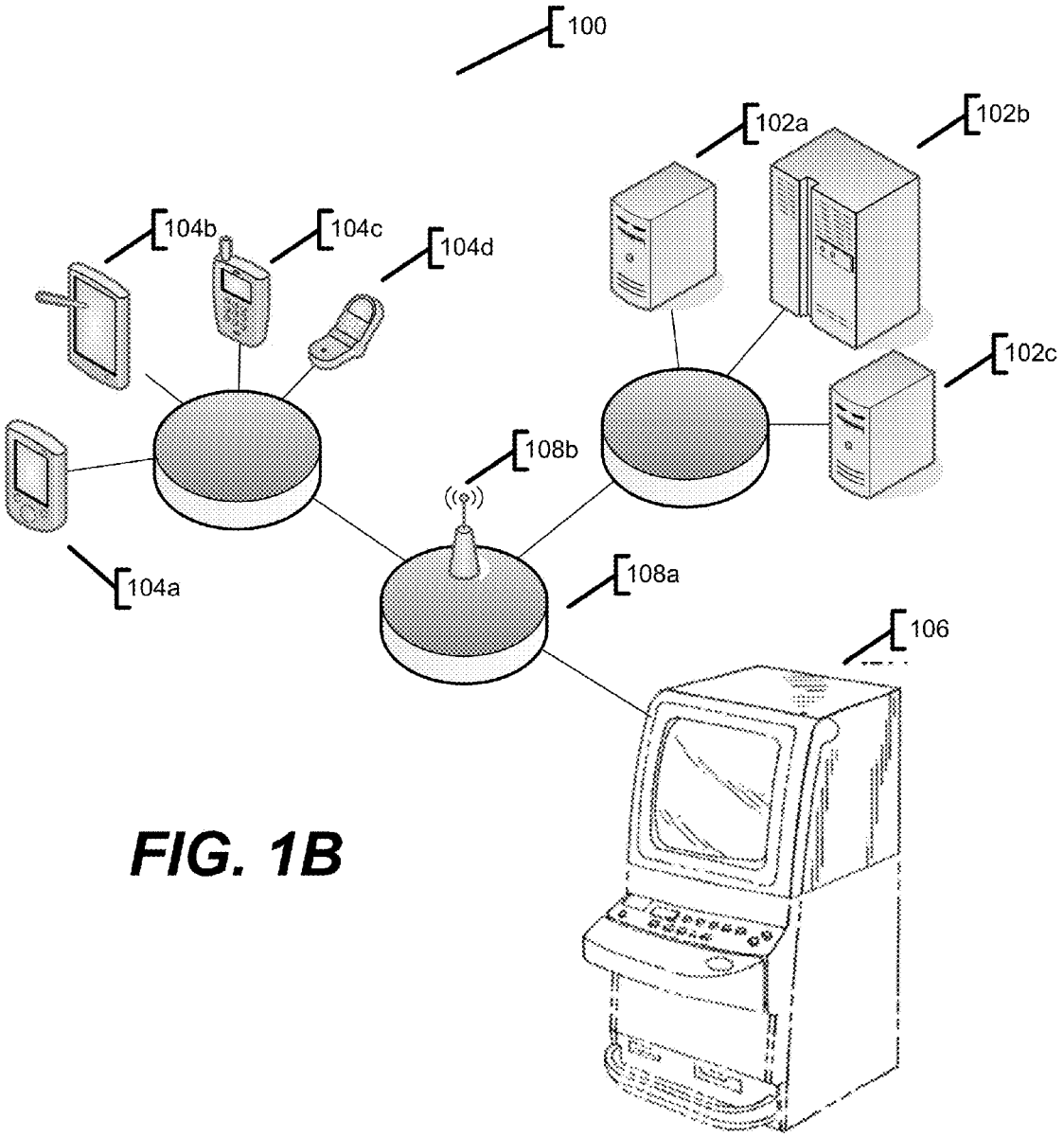

FIG. 1B discloses a player tracking system 100 according to one or more embodiments of the present disclosure. Particularly, this embodiment discloses that a network 108*a* may include both wired connections as well as a wireless network connection 108*b*. The network 108*a* may include a player which is used as a signal conduit between a player's mobile computing device (104*a*-104*d*) and the EGM 106. Additionally, the network 108*a* may include the previously noted wireless connection 108*b* which can include any of the known transmission standards known in the art including, but not limited to, cellular phone networks such as 3GPP, 3G, LTE, etc., Bluetooth, near field communication, or any other known IEEE standard such as 802.11 A, B, G, or N, or 802.16. Additionally, the network 108*a* may also include any host of known wired connections and types such as coaxial cable, fiber optic cable, twisted pair cable (UTP and STP), and power transmission lines which use any of one, but not limited to B-ISDN, DSL, ADSL, ADSL+2, SDSL, VDSL or cable.

According to one or more embodiments of the present disclosure, the player's mobile computing device may be a personal digital assistant ("PDA") or smart phone 104*a*, or a tablet 104*b*. According to another embodiment the player's mobile computing device may be a different style cellular phone 104*c* and 104*d* where the phone includes either the transmitting or receiving device and corresponding touch surface. Further, according to one or more embodiments of the present disclosure, the game system may include a single server, a plurality of servers 102*a* and 102*c*, a mainframe 102*b*, or a combination thereof. In another embodiment the game system may also include a host of other elements such as cameras, sensors, and a host of other computing devices. Further, the EGM 106 may be any EGM known as long as it includes a portion that functions as either the transmitting or receiving device. Furthermore, EGM 106 may be an electronic gaming interface for a traditional card, chip, or dice-based gaming table or device.

Figure 2A:
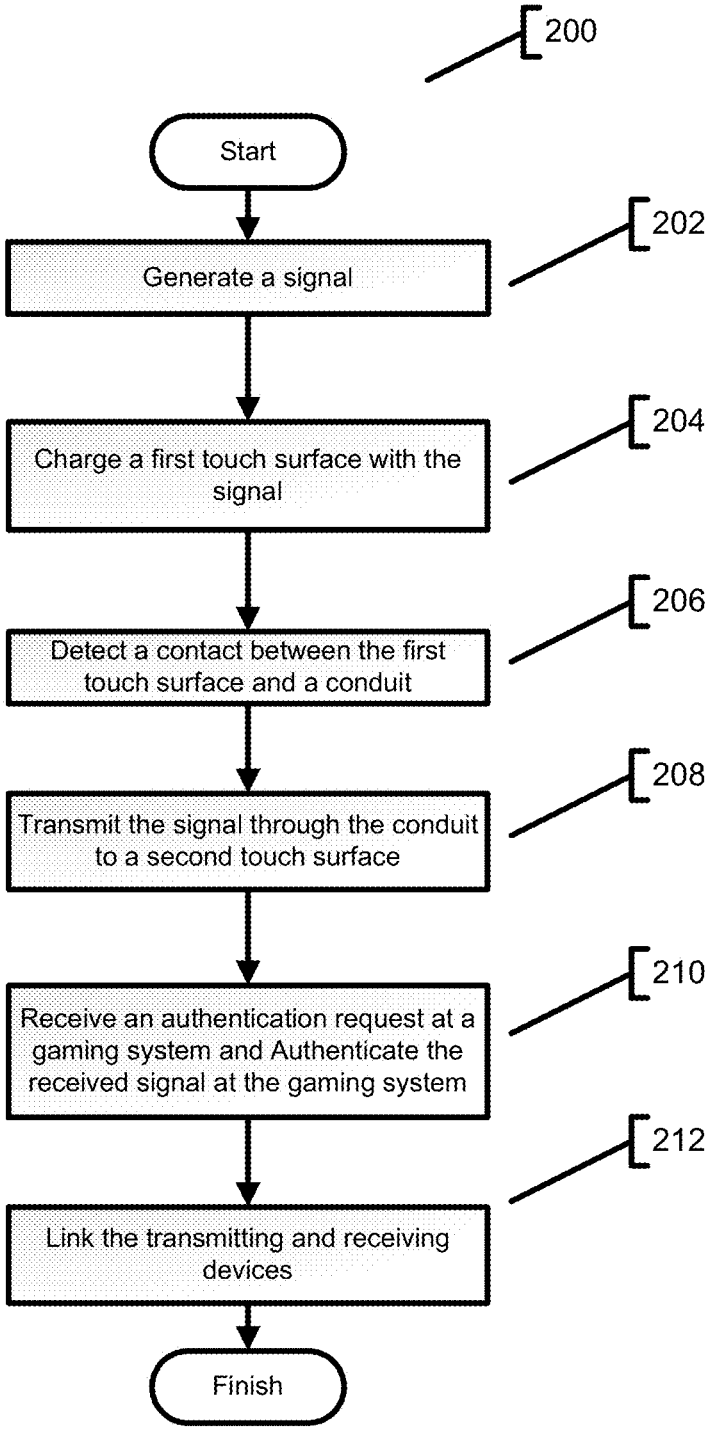
FIGS. 2A-2C show flow diagrams of a method for player tracking according to one or more embodiments of the present disclosure.
Figure 2B:
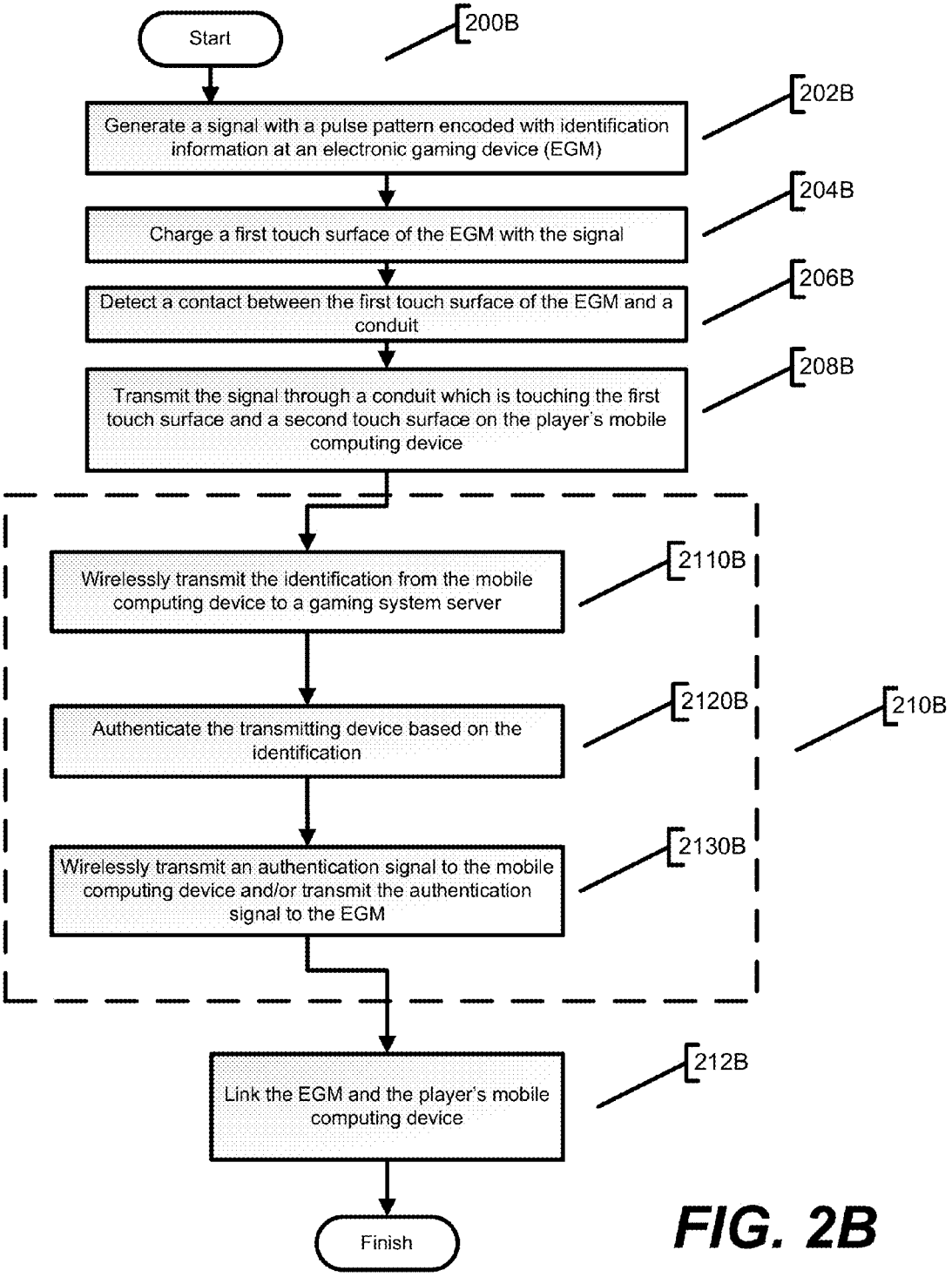
Figure 2C:
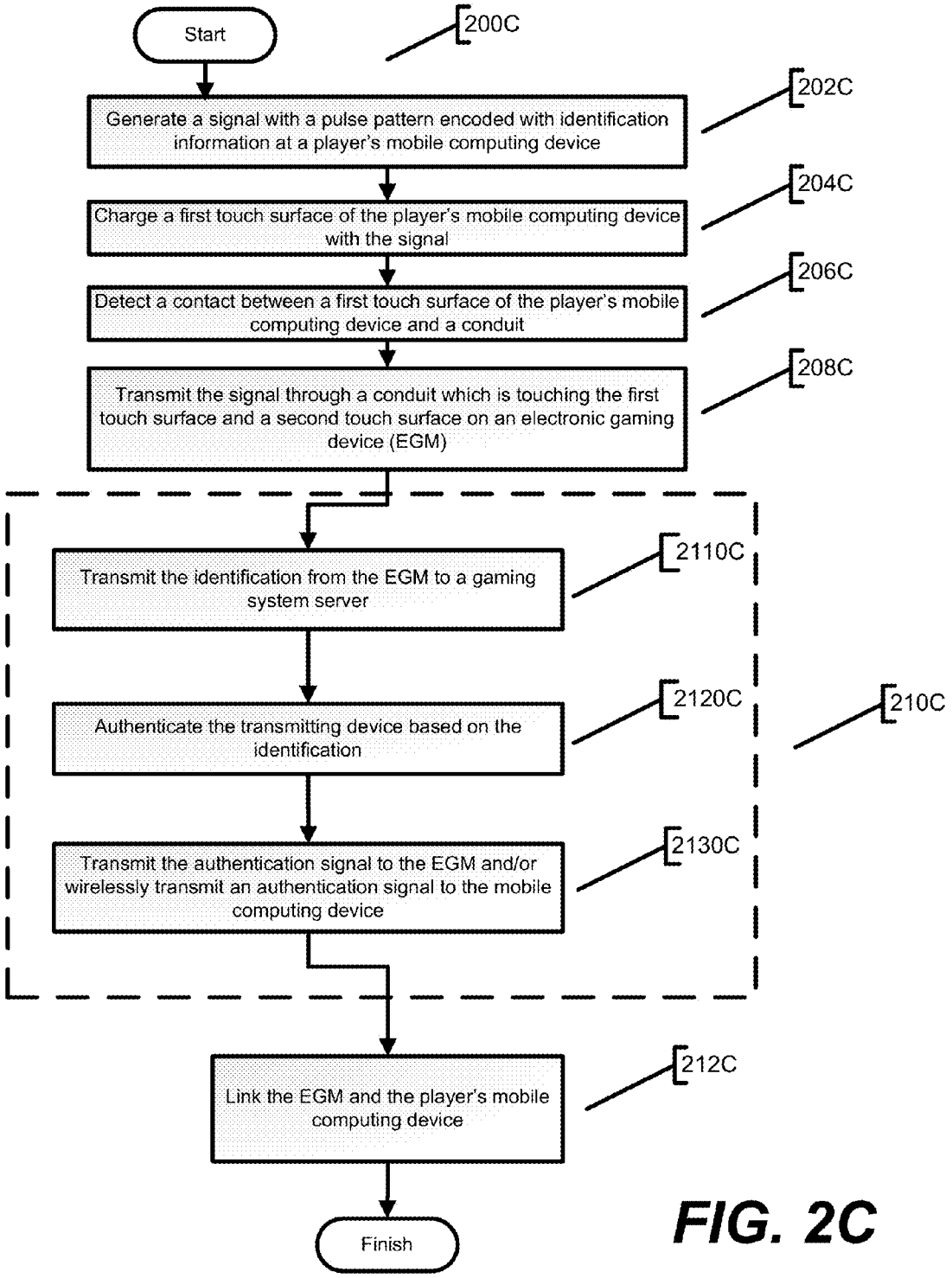

FIGS. 2A-2C show diagrams of a method for player tracking according to one or more embodiments of the present disclosure. While the various steps in these flowcharts are presented and described sequentially, one of ordinary skill in the art will appreciate that some or all of the steps may be executed in different orders and some or all of the steps may be executed in parallel. Further, in one or more embodiments of the invention, one or more of the steps described below may be omitted, repeated, and/or performed in a different order. Accordingly, the specific arrangement of steps shown in FIGS. 2A-2C should not be construed as limiting the scope of the invention.

FIG. 2A shows a flow diagram of a method 200 for player tracking according to one or more embodiments of the present disclosure. Specifically, this embodiment generates a signal 202. Next, this method charges 204 a first touch surface of the transmitting device with the modulated charge that represents the signal. Upon detecting a contact 206 between the first touch surface and a conduit the transmitting device may at that point charge the first touch surface which then transmits 208 the signal through the conduit to a second touch surface of the receiving device. Alternatively, the signal may be continuously transmitted, enabling detection of contact 206 to be omitted. After the conduit transfers the signal from the first touch surface to the second touch surface, communication then occurs with the gaming system to authenticate the signal and the transmitting device from which it came. This authentication request 210 at the gaming system then allows for the linking 212 of the transmitting device and the receiving device. Upon creating this link between the devices other known methods of player tracking can now be used without having the need for a player tracking card.

According to one or more embodiments of the present disclosure, when generating the signal 202, the signal may be modulated to form a pattern that contains data. The data may include identifying information about the transmitting device. In another embodiment it may further contain game specific information as well as other related data.

FIG. 2B shows a flow diagram of a method 200B for player tracking according to one or more embodiments of the present disclosure. Particularly, FIG. 2B depicts a method where an EGM includes the transmitting device and the player's mobile computing device includes the receiving device. Thus, this method generates 202B a signal with a pattern encoded with identification information. This signal may be generated by the EGM with a local software application, or may be provided through a communication link to the gaming system which provides the signal for the EGM's use.

The EGM then takes the signal and charges 204B a first touch surface of the EGM. The first touch surface may be an individual part, or all of, the EGM. For example, according to one embodiment, surfaces of the EGM located adjacent to the display may serve as the first touch surface of the EGM. This would allow for the application to integrate a visual graphics interface to facilitate instructions to the player. Alternatively, according to other embodiments, the first touch surface may be a specific button, a plurality of buttons, a separately designated pad, a particular rail or edge of the EGM, or the entire case of the EGM may serve as the first touch surface.

Thus, according to an embodiment of the present disclosure, a contact is detected 206B between this first touch surface of the EGM and a second touch surface located on a player's mobile computing device. This detection may be ascertained by either the EGM, or the mobile computing device, or even both. In each case, the transmission 208B of the signal may be either continuous or initiated upon touch detection. The transmission 208B is then completed through the conduit, which may be the player's own hand or entire body. The application on the phone may have the functionality to either know how long it must listen to make sure it has acquired the entire signal, or alternatively, it may be able to detect a beginning and ending pattern as defined and known by the application where the identification information, and possibly other information, lies between the starting header and ending portion. In an embodiment where both are able to detect the contact, additional instructional functionality may be implemented for the user's convenience. For example, when the contact is detected, both the EGM and the mobile computing device can update what is shown on their respective screen indicating that the linking is in process.

Next, during the authentication request portion 210B, the signal, or the identification portion thereof, may be transmitted 2110B by the mobile computing device wirelessly to the gaming system. The gaming system then authenticates 2120B and transmits 2130B the authentication and the linkage information to the mobile computing device and possibly also sends the authentication and linkage information to the EGM. Thus, the link 212B between the EGM and player's mobile computing device can be completed by both devices and authenticated and facilitated by the gaming system.

FIG. 2C shows a flow diagram of a method 200C for player tracking according to one or more embodiments of the present disclosure. Specifically, FIG. 2C discloses functionality and limitations of FIG. 2B. The difference between the embodiments being that in FIG. 2C the transmitting device and first touch surface are located on the player's mobile computing device while the receiving device and second touch surface are found on the EGM. Accordingly, this allows for an embodiment where the signal is transmitted from the mobile computing device to the EGM. Specifically, the signal is generated 202C and provided at the mobile computing device. Then the mobile computing device charges 204C, detects 206C, and transmits 208C the signal in a similar fashion as discussed above. Then the EGM, which is in possession of the transmitted signal, communicates 2110C the signal, or a portion thereof, to the gaming system. Next, in this authentication portion 210C, the signal or portion thereof is processed by the gaming system and authenticated 2120C and then a transmission back to either the EGM, mobile computing device (through wireless communication), or both is transmitted 2130C indicated the authentication and any linking information. Thus, the EGM and mobile computing device may then be linked 212C and can therefore proceed with player tracking.

Figure 3A:
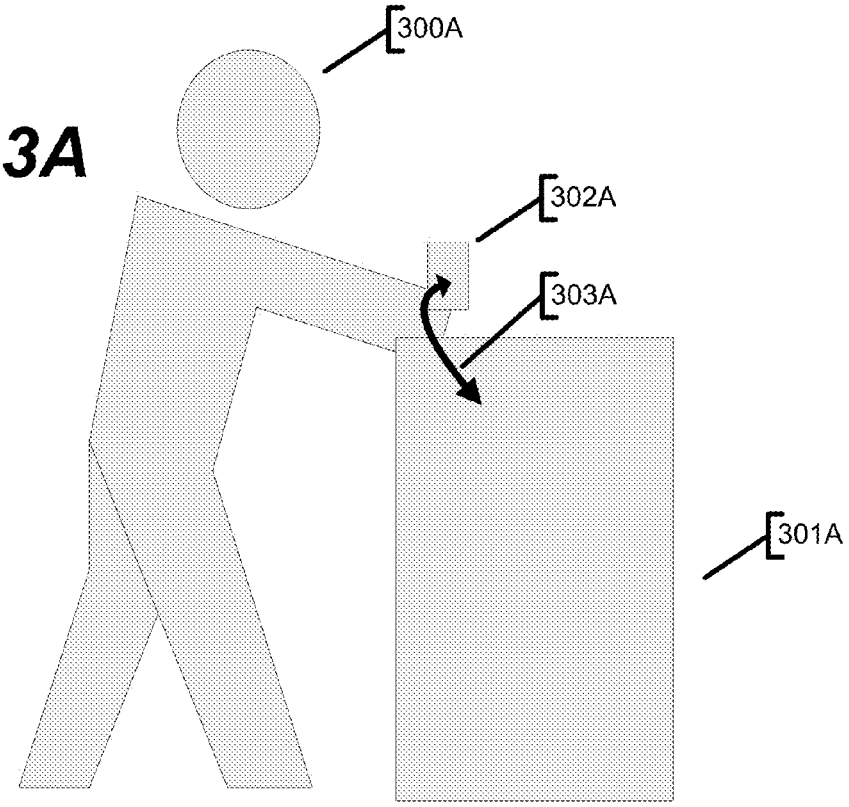
FIGS. 3A-3D show transmission paths of an electrical signal between a mobile computing device and an EGM according to one or more embodiments of the present disclosure.

FIG. 3A shows a transmission path of a signal between a mobile computing device and an EGM according to one or more embodiments of the present disclosure. Specifically, in this figure is shown a player 300A, a mobile computing device 302A, an EGM 301A and the transmission path 303A of the signal. As shown, the player 300A, holding the mobile computing device 302A with one hand, uses that same hand to touch the designated touch surface of the EGM 301A. Thus, the transmission path of the signal is through the hand of the player which acts as the conduit between the two touch surfaces.

Figure 3B:
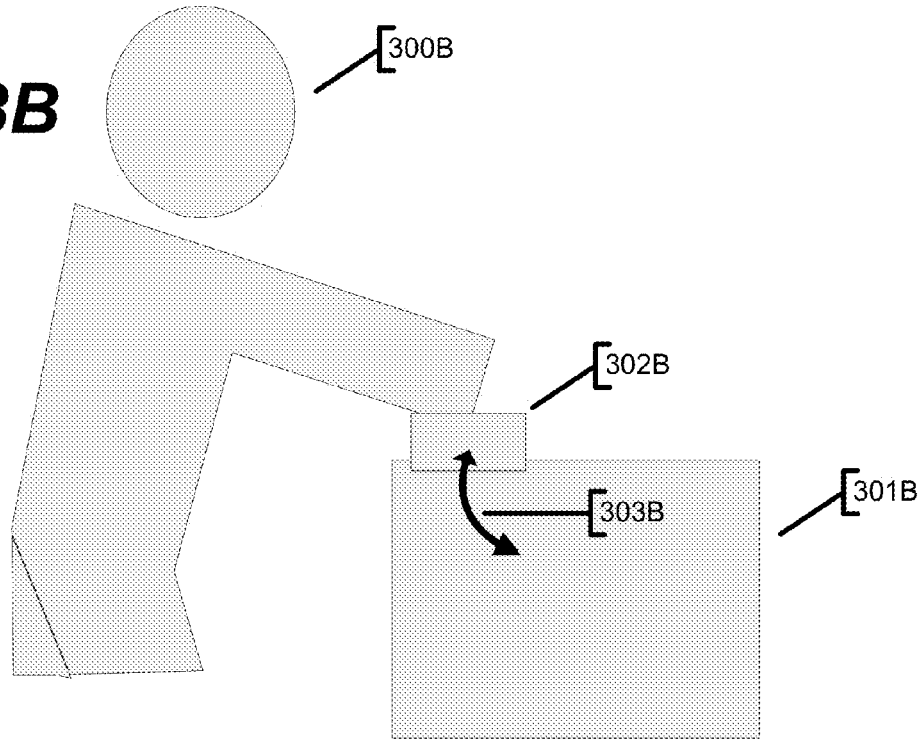

FIG. 3B shows a transmission path of a signal between a mobile computing device and an EGM according to one or more embodiments of the present disclosure. Specifically, FIG. 3B shows a player 300B, a mobile computing device 302B, an EGM 301B, and a transmission path 303B. Here the player 300B places the touch surface of the mobile computing device 302B in direct contact with the touch surface of the EGM 301B such that the surfaces act as direct conduits to each other for the signal. Accordingly, the transmission path 303B is shown going directly from the mobile computing device 302B to the EGM 301B.

Figure 3C:
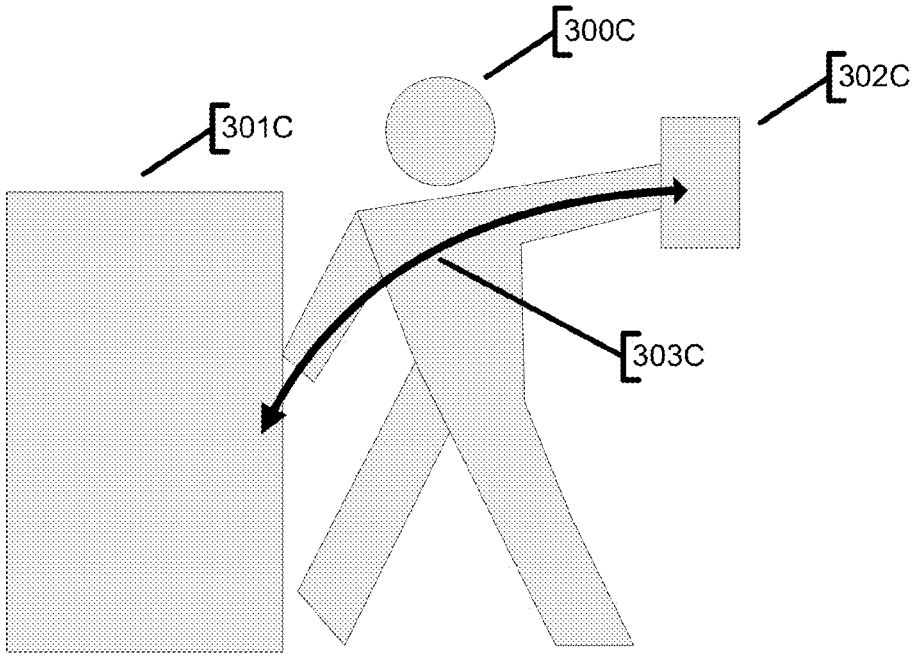

FIG. 3C shows a transmission path of a signal between a mobile computing device and an EGM according to one or more embodiments of the present disclosure. Specifically, FIG. 3C shows a player 300C who is holding their mobile computing device 302C in a first hand. The player's 300C second hand is in contact with the EGM 301C. In this embodiment, when the player completes the circuit between the mobile computing device 302C and the EGM 301C the transmission path 303C for the signal traverses the length of the player's 300C body.

Figure 3D:
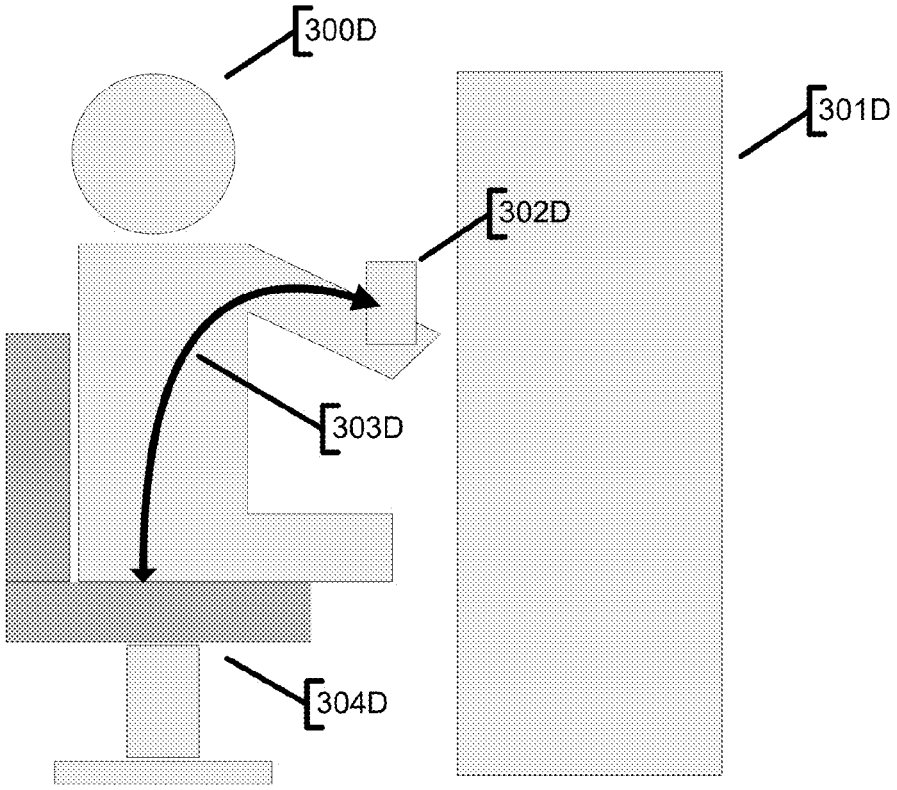

FIG. 3D shows a transmission path 303D of a signal between a mobile computing device 302D and an EGM 301D according to one or more embodiments of the present disclosure. In this embodiment the player 300D is seated in an EGM 301D related seat 304D that is specifically placed, and known to be associated with, the EGM 301D in front of which it is located. Thus, as shown in the figure, the player need not touch the specific EGM 301D as long as they are seated. Thus, when the player initiates the linking application on the player's mobile computing device 302D, the transmission path 303D for the signal is through the player's 300D body to the associated seat 304D in which the player is situated. Further, according to one or more embodiments of the present disclosure, one, a plurality, or all of the transmission paths may be used with a specific EGM and mobile computing device where the EGM and mobile computing device are calibrated to handle all implementations necessary to transmit or receive the signal provided they have the necessary hardware and software as discussed.

Figure 4:
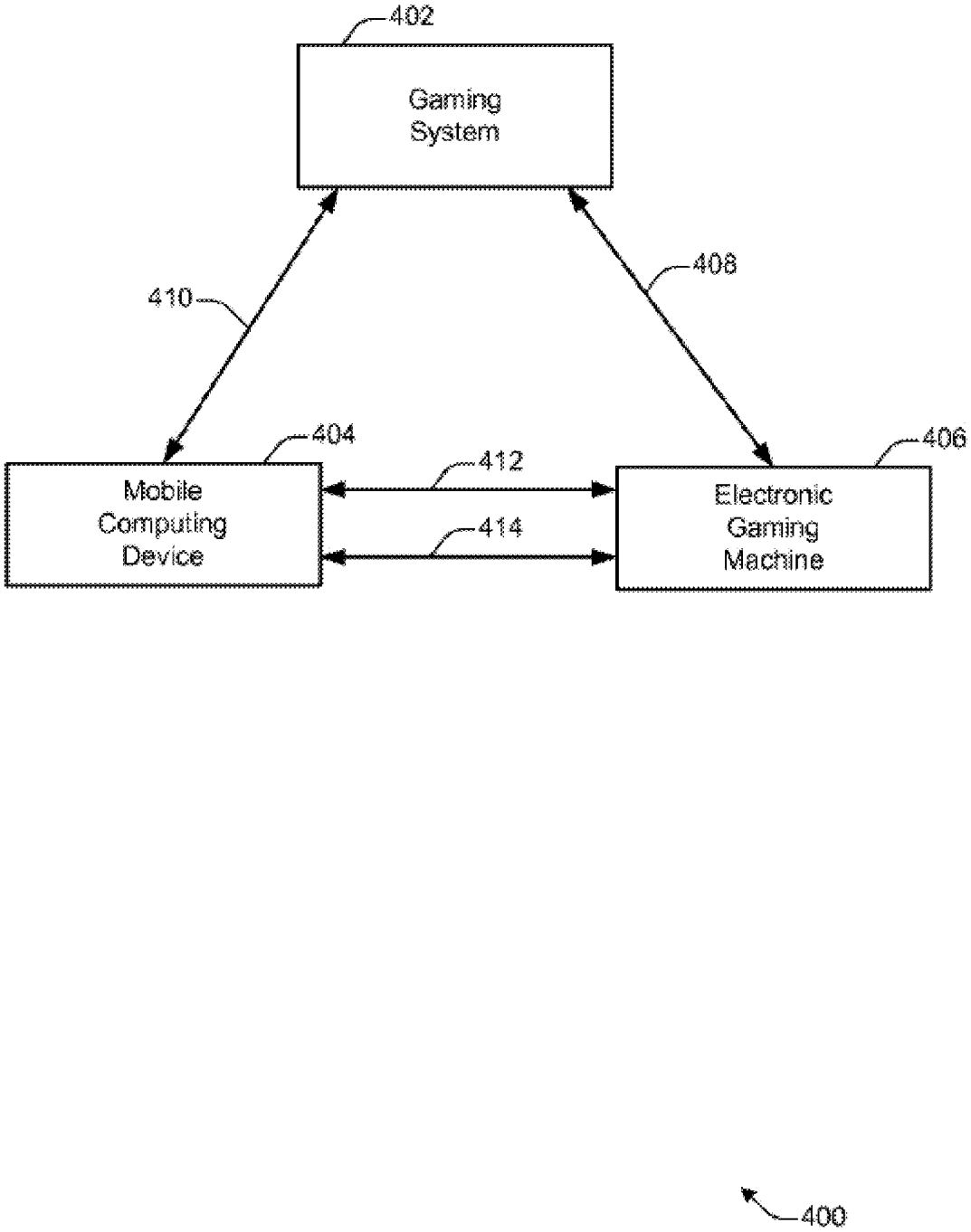
FIG. 4 shows a system diagram for conducting communications in a gaming environment according to one or more embodiments of the present disclosure.

FIG. 4 shows a system diagram 400 for conducting communications in a gaming environment, configured in accordance with one implementation. In some implementations, the system 400 may be used to perform one or more of the techniques discussed with respect to FIGS. 1A-3D. The system 400 includes a gaming system 402, a mobile computing device 404, an electronic gaming machine 406, and communication links 408, 410, 412, and 414.

In some implementations, the gaming system 402 may include various types of servers and computing devices for interfacing with or controlling gaming machines. The gaming system 402 may include servers controlled by the gaming property or casino at which the electronic gaming machine 406 is located. Alternately, or additionally, the gaming system 402 may include servers controlled by another entity or located at another location distinct from the EGM 406, such as another casino, a separate casino data center, a gaming machine manufacturer, a gaming machine software developer, or the player tracking system developer. Additional details regarding gaming systems provided in accordance with one implementation are discussed with respect to FIG. 7.

In some implementations, the mobile computing device 404 may be any computing device capable of being used to perform gaming-related functions such as authentication, cashless gaming, or user input. The types of mobile computing devices that may be used may include, but are not limited to, mobile phones, smart phones, tablet computers, laptop computers, and personal digital assistants. Alternatively, the mobile computing device 404 may be an electronic device provided by the casino which is adapted to implement the player tracking scheme.

In some implementations, the electronic gaming machine 406 may be any gaming machine configured to provide a wager-based game to a player. Additional details regarding an electronic gaming machine provided in accordance with one implementation are discussed with respect to FIGS. 5A and 5B.

In some implementations, the communication links 408, 410, 412, and 414 may be used to facilitate communication between the electronic gaming machine 406, the gaming system 402, and the mobile computing device 404. In some implementations, not all of these communication links may be present. Also, any one of the communication links may be unidirectional in either direction or bidirectional.

In some implementations, the communication link 408 may be a secure communication link for conducting server-based gaming. For example, the communication link 408 may utilize the Gaming Standards Association's G2S Message Protocol. Other implementations may use an open, Ethernet-based SuperSAS protocol. Still other protocols, including but not limited to Best of Breed ("BOB"), may be used to implement various embodiments of the disclosure.

In some implementations, the communication link 408 may be used to transmit various types of information between the gaming system 402 and the electronic gaming machine 406. For instance, the communication link 408 may be used to transmit player identification information, player authentication information, user information, player gains and losses, performance metrics, logon codes, and other such information as described with respect to FIGS. 1A-3D.

In some implementations, the communication link 410 may facilitate communication between the gaming system 402 and the mobile computing device 404. Various types of communication techniques may be used to establish the communication link 410. These communication techniques may include, but are not limited to, mobile phone communication technologies, cellular data communication technologies (e.g., 3G, 4G, EDGE), and wireless networking technologies (e.g., Wi-Fi, Bluetooth, Nearfield). According to another embodiment of the present disclosure, the communication link 410 may be severed or degraded to an unusable degree due to noise interference or ambient signal blocking. In the case where the communication link 410 is inoperable, the communication link 408 can be used to communicate with the gaming system through the EGM and the communication links 412 and 414 can then provide the paths along which the mobile computing device 404 transmits signals along that are designated for the gaming system 402.

In some implementations, the mobile computing device 404 and the gaming system 402 may communicate via message passing or other direct communication techniques. Alternately, or additionally, the mobile computing device 404 and the gaming system 402 may communicate via a Web-based interface. For instance, the gaming system 402 may provide a webpage that may be accessed by the mobile computing device 404 to download software, receive security tokens, provide authentication information, or perform other functions.

In some implementations, the communication link 410 may be used to transmit various types of information between the mobile computing device 404 and the gaming system 402. For example, the mobile computing device 404 may download a gaming application from a digital store not shown in the system 400. Alternately, the mobile computing device 404 may download the gaming application the gaming system 402. The mobile computing device 404 may periodically check with the gaming system 402 or the digital store to download updates to the application.

In some implementations, the mobile computing device 404 may communicate with the gaming system 402 to link the mobile computing device 404 with the player's account. The player may provide identification and authentication information to the gaming system 402 via the mobile computing device 404. Then, the gaming system 402 may store the received information so that when the mobile computing device 404 later communicates with the gaming system 402 or the electronic gaming machine 406, the gaming system 402 may be capable of identifying the player. In some instances, the gaming system 402 may provide a token or other identifier to the mobile computing device 404. The token may be used to facilitate subsequent logons at a gaming machine such as the electronic gaming machine 406. The token may need to be periodically renewed by further communication between the mobile computing device 404 and the gaming system 402.

In some implementations, the mobile computing device 404 may communicate with the gaming system 402 when the player is attempting to use the mobile computing device 404 to communicate with the electronic gaming machine 406. In this case, the mobile computing device 404 may communicate with the gaming system 402 in order to provide additional security or to transmit authentication information for analysis at a server. Alternately, such communications may be conducted at least in part via the electronic gaming machine 406.

In some implementations, a short-range communication link 412 may be used to conduct short-range communications between the mobile computing device 404 and the electronic gaming machine 406. The short-range communication link 412 may be used in order to verify that the mobile computing device 404 is communicating with the gaming machine at which the player is playing rather than with a different, nearby gaming machine. Likewise, the short-range communication link 412 may be used in order to verify that the electronic gaming machine 406 is communicating with the player's mobile computing device rather than a different, nearby mobile computing device, such as a mobile computing device being used by a malicious attacker trying to hijack the player's session or steal the player's information.

In some implementations, various types of information may be transmitted via the short-range communication link 412. For example, long-range communication session information for establishing a long-range communication session may be transmitted. By transmitting this information via the short-range communication link, the integrity of the long-range communication session may be verified. As another example, information identifying the player, such as a username or player tracking number, may be transmitted. By transmitting such information via the short-range communication link 412, the devices and systems shown in FIG. 4 may be better able to verify that subsequent communications are transmitted from a mobile device associated with the player rather than with a different mobile device. As yet another example, information authenticating the player, such as a password, may be transmitted. By transmitting authentication information via a short-range communication link, the chances that the communication will be intercepted may be reduced.

In some implementations, various types of communication techniques may be used to conduct the short-range communications. For example, the mobile computing device 404 and the electronic gaming machine 406 may communicate via active or passive near-field radio. As another example, one device may display a one, two, or three dimensional barcode that may be read by a camera at the other device. As yet another example, the mobile computing device 404 and the electronic gaming machine 406 may communicate via a protocol based on infrared lights, visible lights, sounds, or any other technique for transmitting information. Additionally, as discussed above, for initial authentication and linking of the EGM 406 and the mobile computing device 404 a physical conduit, such as the player, may be used as a physical channel 412 over which a signal can be transmitted.

In some implementations, a long-range communication link 414 may be used to conduct long-range communications between the mobile computing device 404 and the electronic gaming machine 406. The long-range communication link 414 may be used in order to allow the mobile computing device 404 to communicate with the electronic gaming machine 406 while the mobile computing device 404 is less proximate to the gaming machine than is the case when the electronic gaming machine 406 and the mobile computing device 404 are communicating via the short-range communication link 412. For example, the player may hold the mobile computing device while the player is standing or sitting in front of the gaming machine. As another example, the player may pause play and carry the mobile computing device while the player visits a rest room.

In some implementations, the long-range communication link 414 may be established based on information shared via the short-range communication link 412. In this way, the integrity of the long-range communication link 414 may be verified. Various types of information may be transmitted via the long-range communication link 414. This information may include, but is not limited to: user input for the electronic gaming machine 406, player identification information, player authentication information, cashless gaming information, player tracking information, and player biometric information.

In some implementations, various types of communication techniques may be used to conduct the long-range communications. These communication techniques may include, but are not limited to, mobile phone communication technologies, cellular data communication technologies (e.g., 3G, 4G, EDGE, LTE), and wireless networking technologies (e.g., Wi-Fi, Bluetooth).

Figure 5:
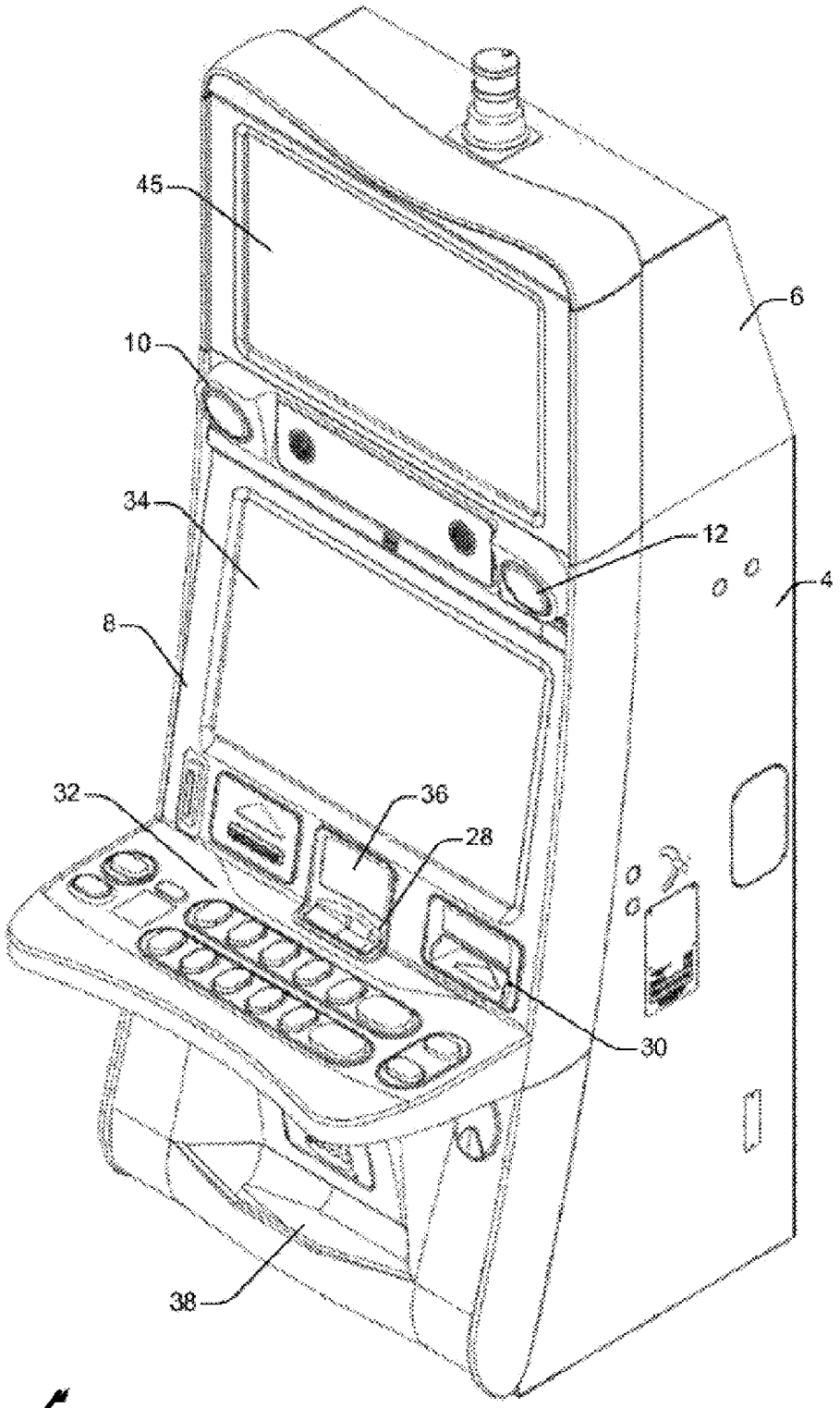
FIGS. 5, 6A, and 6B show perspective diagrams of a gaming machine according to one or more embodiments of the present disclosure.
Figure 6A:
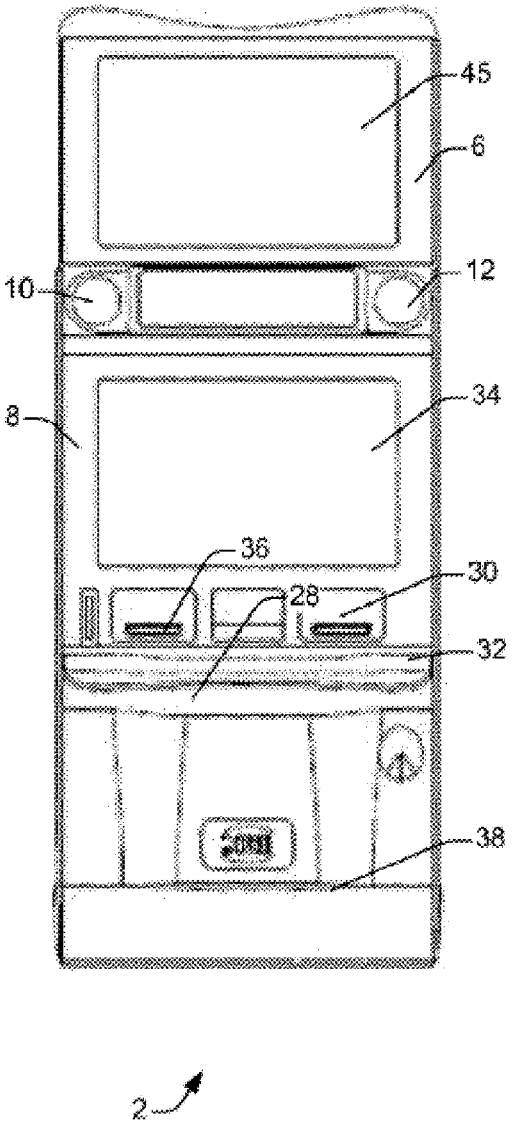
Figure 6B:
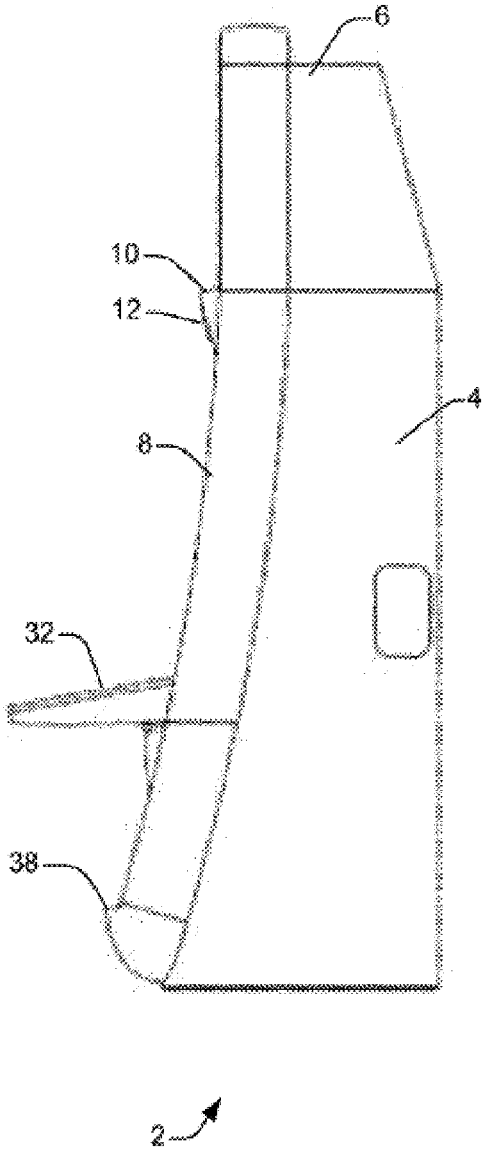

FIGS. 5, 6A, and 6B show perspective diagrams of a gaming machine 2, configured in accordance with one implementation. As illustrated in FIGS. 5, 6A, and 6B, gaming machine 2 includes a main cabinet 4, which generally surrounds the machine interior and is viewable by users. The main cabinet includes a main door 8 on the front of the machine, which opens to provide access to the interior of the machine. According to one embodiment of the present disclosure, the entire gaming machine 2 may be a touch surface configured to transmit the signal, and optionally, detect when it is touched. Alternatively, the main cabinet 4 or the main door 8 may also serve as the touch surface. Alternately, a portion of the door or cabinet may be electrically isolated from the rest and designated as the contact surface.

In some implementations, the EGM may include any of a plurality of devices. For example, the EGM may include a ticket printer that prints bar-coded tickets, a key pad for entering player tracking information, and a display (e.g., a video display screen) for displaying player tracking information. The EGM may maintain a card reader for entering a magnetic striped card containing player tracking information, in addition to the disclosed player tracking alternative, and any other devices. The ticket printer may be used to print tickets for a cashless ticketing system. In FIGS. 5, 6A, and 6B, attached to the main door is a payment acceptor 28, a bill validator 30, and a coin tray 38. The payment acceptor may include a coin slot, where the player inserts coins, tokens, credit or debit cards, or other types of payments. Any one of, or all of these elements may also serve as the touch surface for initiating the link and authentication for player tracking.

In some implementations, devices such as readers or validators for currency or credit cards, debit cards, smart cards, or credit slips may facilitate payment. For example, a player may insert an identification card into a card reader of the gaming machine. The identification card may be a smart card coded with a player's identification, credit totals or related data and other relevant information. As another example, a player may carry a portable device, such as a cell phone, a radio frequency identification tag or any other suitable wireless device. The portable device may communicate a player's identification, credit totals or related data, and/or any other relevant information to the gaming machine. As yet another example, money may be transferred to a gaming machine through electronic funds transfer. When a player funds the gaming machine, a logic device coupled to the gaming machine may determine the amount of funds entered and display the corresponding amount on a display device.

In some implementations, attached to the main door is a plurality of player-input switches or buttons 32. The input switches can include any suitable devices which enables the player to produce an input signal which is received by the processor. The input switches may include a game activation device that may be used by the player to start any primary game or sequence of events in the gaming machine. The game activation device can be any suitable play activator such as a "bet one" button, a "max bet" button, or a "repeat the bet" button. In some instances, upon appropriate funding, the gaming machine may begin the game play automatically. Alternately, the gaming machine may automatically activate game play after detecting user input via the game activation device.

In some implementations, one input switch is a cash-out button. The player may push the cash-out button and cash out to receive a cash payment or other suitable form of payment corresponding to the number of remaining credits. For example, when the player cashes out, the player may receive the coins or tokens in a coin payout tray. As another example, the player may receive other payout mechanisms such as tickets or credit slips redeemable by a cashier (or other suitable redemption system) or funding to the player's electronically recordable identification card. As yet another example, funds may be transferred from the gaming machine to the player's smart card or to an account associated with the smart device that was used to establish a link between the player and the EGM.

In some implementations, one input switch may be a touch-screen coupled with a touch-screen controller, or some other touch-sensitive display overlay to enable for player interaction with the images on the display. The touch-screen and the touch-screen controller may be connected to a video controller. A player may make decisions and input signals into the gaming machine by touching the touch-screen at the appropriate places. One such input switch is a touch-screen button panel.

In some implementations, the gaming machine may include communication ports for enabling communication of the gaming machine processor with external peripherals, such as external video sources, expansion buses, game or other displays, a SATA port, a key pad, or a network interface for communicating via a network.

In some implementations, the electronic gaming machine may include one or more display devices. For example, the electronic gaming machine 2 includes a display device 34 and an information panel 36. The display device 34 and the information panel 36 may each include any of a cathode ray tube, an LCD, a light emitting diode (LED) based display, an organic light emitting diode (OLED) based display, a polymer light emitting diode (PLED) based display, an SED based-display, an E-ink display, a plasma display, a television display, a display including a projected and/or reflected image, or any other suitable electronic display device.

In some implementations, the display devices at the gaming machine may include one or more electromechanical devices such as one or more rotatable wheels, reels, or dice. The display device may include an electromechanical device adjacent to a video display, such as a video display positioned in front of a mechanical reel. The display devices may include dual-layered or multi-layered electromechanical and/or video displays that cooperate to generate one or more images. The display devices may include a mobile display device, such as a smart phone or tablet computer, which allows play of at least a portion of the primary or secondary game at a location remote from the gaming machine. The display devices may be of any suitable size and configuration, such as a square, a rectangle or an elongated rectangle.

In some implementations, the display devices of the gaming machine are configured to display game images or other suitable images. The images may include symbols, game indicia, people, characters, places, things, faces of cards, dice, and any other images. The images may include a visual representation or exhibition of the movement of objects such as mechanical, virtual, or video reels and wheel. The images may include a visual representation or exhibition of dynamic lighting, video images, or any other images.

In some implementations, the electronic gaming machine may include a top box. For example, the gaming machine 2 includes a top box 6, which sits on top of the main cabinet 4. The top box 6 may house any of a number of devices, which may be used to add features to a game being played on the gaming machine 2. These devices may include speakers 10 and 12, display device 45, and any other devices. Further, the top box 6 may house different or additional devices not illustrated in FIGS. 5, 6A, and 6B. For example, the top box may include a bonus wheel or a back-lit silk screened panel which may be used to add bonus features to the game being played on the gaming machine. As another example, the top box may include a display for a progressive jackpot offered on the gaming machine. As yet another example, the top box may include a smart card interaction device. During a game, these devices are controlled and powered, at least in part, by circuitry (e.g. a master gaming controller) housed within the main cabinet 4 of the machine 2.

In some implementations, speakers may be mounted and situated in the cabinet with an angled orientation toward the player. For instance, the speakers 10 and 12 located in top box area 6 of the upper region of gaming machine 2 may be mounted and situated in the cabinet with an angled orientation down towards the player and the floor. In one example, the angle is 45 degrees with respect to the vertical, longitudinal axis of machine 2. In another example, the angle is in a range of 30-60 degrees. In another example, the angle is any angle between 0 and 90 degrees. In some implementations, the angle of speakers in the gaming machine may be adjustable. For instance, speakers may be adjusted to face in a direction more closely approximating an estimated position of a player's head or facial features.

The bill validator 30, player-input switches 32, display screen 34, and other gaming devices may be used to present a game on the game machine 2. The devices may be controlled by code executed by a master gaming controller housed inside the main cabinet 4 of the machine 2. The master gaming controller may include one or more processors including general purpose and specialized processors, such as graphics cards, and one or more memory devices including volatile and non-volatile memory. The master gaming controller may periodically configure and/or authenticate the code executed on the gaming machine.

In some implementations, the gaming machine may include a sound generating device coupled to one or more sounds cards. The sound generating device may include one or more speakers or other sound generating hardware and/or software for generating sounds, such as playing music for the primary and/or secondary game or for other modes of the gaming machine, such as an attract mode. The gaming machine may provide dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized for or to provide any appropriate information.

In some implementations, the gaming machine may include a sensor, such as a camera that is selectively positioned to acquire an image of a player actively using the gaming machine and/or the surrounding area of the gaming machine. The sensor may be configured to capture biometric data about a player in proximity to the gaming machine. The biometric data may be used to implement mechanical and/or digital adjustments to the gaming machine. Alternately, or additionally, the sensor may be configured to selectively acquire still or moving (e.g., video) images. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol, animated avatar, or game indicia.

Gaming machine 2 is but one example from a wide range of gaming machine designs on which the techniques described herein may be implemented. For example, not all suitable gaming machines have top boxes or player tracking features. Further, some gaming machines have only a single game display—mechanical or video, while others may have multiple displays. Any one of, or all of the above discussed specific elements of the gaming machine, or EGM, 2 may also serve as the touch surface for initiating the link and authentication for player tracking as disclosed in the embodiments shown in FIGS. 1A-3D.

Figure 7:
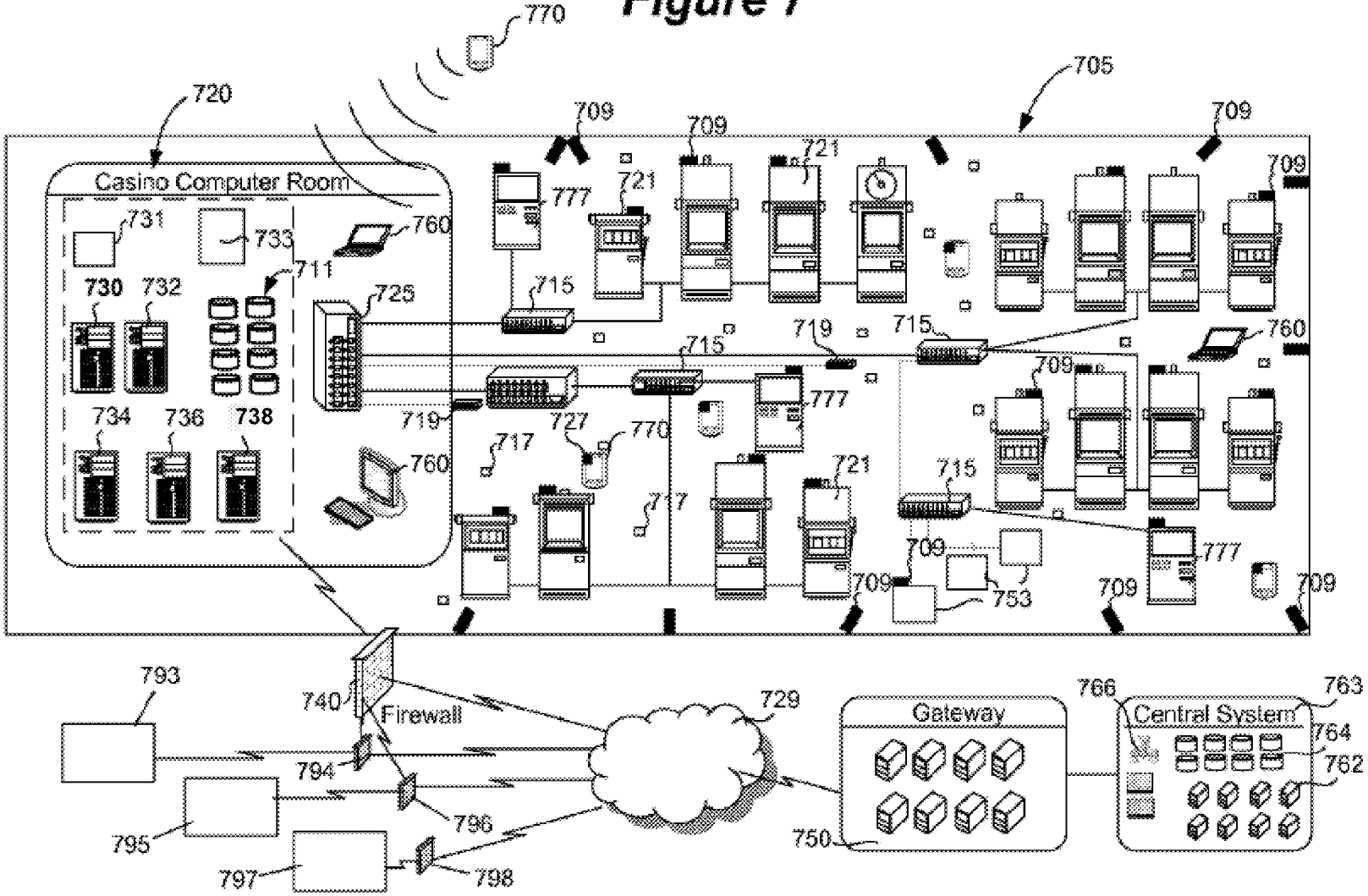
FIG. 7 shows a server-based gaming network according to one or more embodiments of the present disclosure.

FIG. 7 shows a server-based (sb.TM.) gaming network, configured in accordance with some implementations. Those of skill in the art will realize that this architecture and the related functionality are merely examples and that the present disclosure encompasses many other such embodiments and methods.

Here, casino computer room 720 and networked devices of a gaming establishment 705 are illustrated. Gaming establishment 705 is configured for communication with central system 763 via gateway 750. Gaming establishments 793 and 795 are also configured for communication with central system 763.

In some implementations, gaming establishments may be configured for communication with one another. In this example, gaming establishments 793 and 795 are configured for communication with casino computer room 720. Such a configuration may allow devices and/or operators in the gaming establishment also known as a casino, 705 to communicate with and/or control devices in other casinos. In some such implementations, a server in computer room 720 may control devices in the gaming establishment/casino 705 and devices in other gaming establishments. Conversely, devices and/or operators in another gaming establishment may communicate with and/or control devices in casino 705.

For example, a server of casino 705 or central system 763 may be provisioned with relatively more advanced software (e.g., 3-D facial recognition software) for patron identification than servers of other networked locations. Such a server may process patron identification requests from devices in casino 705 as well as patron identification requests from devices in gaming establishments 793 and 795.

Here, gaming establishment 797 is configured for communication with central system 763, but is not configured for communication with other gaming establishments. Some gaming establishments (not shown) may not be in communication with other gaming establishments or with a central system. Gaming establishment 705 includes multiple gaming machines 721, each of which is part of a bank of gaming machines 721. In this example, gaming establishment 705 also includes a bank of networked gaming tables 753. However, the present disclosure may be implemented in gaming establishments having any number of gaming machines, gaming tables, etc. It will be appreciated that many gaming establishments include hundreds or even thousands of gaming machines 721 and/or gaming tables 753, not all of which are necessarily included in a bank and some of which may not be connected to a network. At least some of gaming machines 721 and/or mobile devices 770 may be "thin clients" that are configured to perform client-side methods as described elsewhere herein.

Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 753 may be configured for communication with individual player terminals (not shown), which may be configured to accept bets, present an electronic representation of a dealer, indicate game outcomes, etc.

Gaming establishment 705 also includes networked kiosks 777. Depending on the implementation, kiosks 777 may be used for various purposes, including but not limited to cashing out, prize redemption, redeeming points from a player loyalty program, redeeming "cashless" indicia such as bonus tickets, smart cards, etc. In some implementations, kiosks 777 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present disclosure. For example, in some implementations of the disclosure, kiosks 777 may be configured to receive information from a patron, e.g., by presenting graphical user interfaces.

In this example, each bank 710 has a corresponding switch 715, which may be a conventional bank switch in some implementations. Each switch 715 is configured for communication with one or more devices in computer room 720 via main network device 725, which combines switching and routing functionality in this example. Although various communication protocols may be used, some preferred implementations use the Gaming Standards Association's G2S Message Protocol. Other implementations may use the open, Ethernet-based SuperSAS protocol, which is available from IGT. Still other protocols, including but not limited to Best of Breed ("BOB"), may be used to implement various embodiments of the disclosure. IGT has also developed a gaming-industry-specific transport layer called CASH that rides on top of TCP/IP and offers additional functionality and security.

Here, gaming establishment 705 also includes an RFID network, implemented in part by RFID switches 719 and multiple RFID readers 717. An RFID network may be used, for example, to track objects (such as mobile gaming devices 770, which include RFID tags 727 in this example), patrons, etc., in the vicinity of gaming establishment 705.

As noted elsewhere herein, some implementations of the disclosure may involve "smart" player loyalty instruments, such as player tracking cards, which include an RFID tag. Accordingly, the location of such RFID-enabled player loyalty instruments may be tracked via the RFID network. In this example, at least some of mobile devices 770 may include an RFID tag 727, which includes encoded identification information for the mobile device 770. Accordingly, the locations of such tagged mobile devices 770 may be tracked via the RFID network in gaming establishment 705. Other location-detection devices and systems, such as the global positioning system ("GPS"), may be used to monitor the location of people and/or devices in the vicinity of gaming establishment 705 or elsewhere.

Various alternative network topologies can be used to implement different embodiments of the disclosure and/or to accommodate varying numbers of networked devices. For example, gaming establishments with large numbers of gaming machines 721 may require multiple instances of some network devices (e.g., of main network device 725, which combines switching and routing functionality in this example) and/or the inclusion of other network devices not shown in FIG. 7. Some implementations of the disclosure may include one or more middleware servers disposed between kiosks 777, RFID switches 719 and/or bank switches 715 and one or more devices in the computer room 720 (e.g., a corresponding server). Such middleware servers can provide various useful functions, including but not limited to the filtering and/or aggregation of data received from switches, from individual gaming machines and from other devices. Some implementations of the disclosure include load-balancing methods and devices for managing network traffic.

Storage devices 711, sb.TM. server 730, License Manager 731, Arbiter 733, servers 732, 734, 736 and 738, host device (s) 760 and main network device 725 are disposed within computer room 720 of gaming establishment 705. In practice, more or fewer devices may be used. Depending on the implementation, some such devices may reside in gaming establishment 705 or elsewhere.

One or more devices in central system 763 may also be configured to perform, at least in part, tasks specific to the present disclosure. For example, one or more servers 762, arbiter 733, storage devices 764 and/or host devices 760 of central system 763 may be configured to implement the functions described in detail elsewhere herein. These functions may include, but are not limited to, providing functionality for devices such as wager gaming machines 721, mobile devices 770, etc.

One or more of the servers of computer room 720 may be configured with software for receiving a player's wager gaming notification parameters, determining when a wagering condition corresponds with the wager gaming notification parameters and/or providing a notification to the player when the wagering condition corresponds with the wager gaming notification parameters. Moreover, one or more of the servers may be configured to receive, process and/or provide image data from cameras 709, to provide navigation data to patrons (e.g., to indicate the location of and/or directions to a gaming table, a wager gaming machine, etc., associated with a wager gaming notification), etc.

For example, navigation data (which may include map data, casino layout data, camera image data, etc.) may be provided by one or more of the servers of computer room 720 to mobile devices 770. Some implementations of the present disclosure include a plurality of networked cameras 709, which may be video cameras, smart cameras, digital still cameras, etc. In some such implementations, such cameras may provide, at least in part, real-time navigation.

Other devices that may be deployed in the casino network do not appear in FIG. 7. For example, some gaming networks may include not only various radio frequency identification ("RFID") readers 717, but also RFID switches, middleware servers, etc., some of which are not depicted in FIG. 7. These features may provide various functions. For example, a server (or another device) may determine a location of a mobile device 770 according to the location of an RFID reader that reads an RFID tag 727.

The servers and other devices indicated in FIG. 7 may be configured for communication with other devices in or outside of gaming establishment 705, such as host devices 760, kiosks 777 and/or mobile devices 770, for implementing some methods described elsewhere herein. Servers (or the like) may facilitate communications with such devices, receive and store patron data, provide appropriate responses, etc., as described elsewhere herein.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the disclosure provide one or more of these servers in the form of blade servers.

Some embodiments of sb.TM. server 730 and the other servers shown in FIG. 7 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the disclosure, many of these devices (including but not limited to License Manager 731, servers 732, 734, 736, and 738, and main network device 725) are mounted in a single rack with sb.TM. server 730. Accordingly, many or all such devices will sometimes be referenced in the aggregate as an "sb.TM. server." However, in alternative implementations, one or more of these devices is in communication with sb.TM. server 730 and/or other devices of the network but located elsewhere. For example, some of the devices could be mounted in separate racks within computer room 720 or located elsewhere on the network. Moreover, it can be advantageous to store large volumes of data elsewhere via a storage area network ("SAN").

Computer room 720 may include one or more operator consoles or other host devices that are configured for communication with other devices within and outside of computer room 720. Such host devices may be provided with software, hardware and/or firmware for implementing various embodiments of the disclosure. However, such host devices need not be located within computer room 720. Wired host devices 760 (which are desktop and laptop computers in this example) and wireless devices 770 (which are mobile computing devices in this example) may be located elsewhere in gaming establishment 705 or at a remote location.

These and other aspects of the disclosure may be implemented by various types of hardware, software, firmware, etc. For example, some features of the disclosure may be implemented, at least in part, by machine-readable media that include program instructions, state information, etc., for performing various operations described herein. Examples of program instructions include both machine code, such as produced by a compiler, and files containing higher-level code that may be executed by the computer using an interpreter. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices ("ROM") and random access memory ("RAM").

Any of the above embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

While various embodiments have been described herein, it should be understood that they have been presented by way of example only, and not limitation. Thus, the breadth and scope of the present application should not be limited by any of the embodiments described herein, but should be defined only in accordance with the following and later-submitted claims and their equivalents. In other words, while the invention as claimed has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electronic gaming machine comprising:

a housing;

a first touch surface supported by the housing and configured to detect a touch by a person and receive an identifying signal through the person while the person is in contact with the first touch surface and also in contact with a second touch surface of a mobile computing device, wherein the identifying signal is generated by the mobile computing device;

a communication interface configured to communicate with a gaming server;

a processor configured to communicate with the communication interface and the first touch surface, and further configured to:

receive the identifying signal;

in response to receiving the identifying signal, cause the communication interface to transmit an authentication request to the gaming server, wherein the authentication request includes identification information included in the identifying signal;

receive an authentication signal through the communication interface, wherein the authentication signal is generated by the gaming server after authenticating the identification information included in the authentication request; and in response to receiving the authentication signal, enable player tracking with the mobile computing device.

2. The electronic gaming machine of claim 1, wherein the mobile computing device is one of a personal digital assistant (PDA), a smartphone, a tablet, a netbook, a laptop, and a cellular phone.

3. The electronic gaming machine of claim 1, wherein the identifying signal includes a patterned code.

4. The electronic gaming machine of claim 3, wherein the processor is configured to:

decode the patterned code to obtain the identification information; and generate the authentication request to include the identification information decoded from the patterned code.

5. The electronic gaming machine of claim 1, wherein the identification information identifies at least one of the mobile computing device or user associated with the mobile computing device.

6. The electronic gaming machine of claim 1, wherein the processor is configured to:

cause the communication interface to establish wireless communication with the mobile computing device.

7. The electronic gaming machine of claim 6, wherein the wireless communication is established according to at least one of a mobile phone protocol, cellular data protocol, and a wireless networking protocol.

8. The electronic gaming machine of claim 6, wherein the processor is configured to:

cause the communication interface to receive player tracking information from the mobile computing device via the wireless communication link.

9. The electronic gaming machine of claim 6, wherein the processor is configured to:

cause the communication interface to receive verification information from the mobile computing device while the player tracking is enabled; and verify the player tracking with the mobile computing device based on the received verification information.

10. A method of operating an electronic gaming machine, said method comprising:

causing a processor of the electronic gaming machine configured to communicate with a first touch surface of the electronic gaming machine and a communication interface of the electronic gaming machine, to:

receive a detection signal identifying a touch by a person is detected by the first touch surface;

receive an identifying signal generated by a mobile computing device, wherein the identifying signal is received through the first touch surface while the person is in contact with the first touch surface and also in contact with a second touch surface of the mobile computing device;

cause a communication interface to transmit an authentication request to a gaming server in response to receiving the identifying signal, wherein the authentication request includes identification information included in the identifying signal;

receive an authentication signal through the communication interface, wherein the authentication signal is generated by the gaming server after authenticating the identification information included in the authentication request; and enable player tracking with the mobile computing device in response to receiving the authentication signal.

11. The method of claim 10, wherein the mobile computing device is one of a personal digital assistant (PDA), a smartphone, a tablet, a netbook, a laptop, and a cellular phone.

12. The method of claim 10, wherein the identifying signal comprises a patterned code.

13. The method of claim 12, which includes causing the processor to:

decode the patterned code;

obtain the identification information based on the decoded patterned code; and generate the authentication request to include the identification information.

14. The method of claim 10, wherein the identification information identifies at least one of the mobile computing device or user associated with the mobile computing device.

15. The method of claim 10, which includes causing the processor:

cause the communication interface to establish wireless communication with the mobile computing device.

16. The method of claim 15, wherein the wireless communication is established according to at least one of a mobile phone protocol, cellular data protocol, and a wireless networking protocol.

17. The method of claim 15, which includes causing the processor to:

cause the communication interface to receive player tracking information from the mobile computing device via the wireless communication link.

18. The method of claim 15, which includes causing the processor to:

cause the communication interface to receive verification information from the mobile computing device while the player tracking is enabled; and verifying, by the processor, the player tracking with the mobile computing device based on the received verification information.

* * * * *